United States Patent [19]

Ellingsen et al.

[11] 4,411,298

[45] Oct. 25, 1983

[54] LOG SPLITTER MOUNTING ARRANGEMENT

[75] Inventors: Raymond L. Ellingsen, Oshkosh; Dale A. Manteufel, Hortonville, both of Wis.

[73] Assignee: J. I. Case Company, Racine, Wis.

[21] Appl. No.: 310,104

[22] Filed: Oct. 9, 1981

[51] Int. Cl.[3] ..... B27L 7/00

[52] U.S. Cl. ..... 144/193 A; 280/415 R; 403/87; 403/328

[58] Field of Search ..... 144/193 R, 193 A; 403/84, 87, 328; 280/415 R, 415 A

[56] References Cited

U.S. PATENT DOCUMENTS

| | | | |
|---|---|---|---|
| 3,721,461 | 3/1973 | Nelsen et al. | 280/415 R |
| 4,236,556 | 12/1980 | Smith | 144/193 A |
| 4,240,476 | 12/1980 | Rattray | 144/193 A |
| 4,343,484 | 8/1982 | Van Antwerp | 280/415 R |

*Primary Examiner*—W. D. Bray

*Attorney, Agent, or Firm*—Dressler, Goldsmith, Shore, Sutker & Milnamow, Ltd.

[57] ABSTRACT

A mounting arrangement for a tractor supported log splitter is disclosed to accommodate reorientation of the splitter with respect to the tractor hitch. The mounting arrangement includes a hitch adapter which supports a female socket, and a male plug connected to the log splitter which is adapted to be received within the female socket. Relative angular repositioning of the log splitter is provided by relative movement of the male plug within the female socket, with a locking mechanism provided so that the log splitter may be releasably locked in the selected position. In this way, the log splitter may be used in a conventional fashion by positioning logs atop its cutting table, or it may be rotated along a line generally parallel to the line of cutting action of the splitter so that logs may be split while they are on the ground without having to lift them onto the splitter cutting table.

5 Claims, 4 Drawing Figures

10
12
14
16
18
20
22
24
26
28
30
32
34
36
38
40
42
44
46
48
50
52
54
56
58
60
61
62

LOG SPLITTER MOUNTING ARRANGEMENT

TECHNICAL FIELD

The present invention pertains generally to tractor mounted implements, and more particularly to an arrangement for mounting a log splitter on a tractor hitch or other support.

BACKGROUND OF THE INVENTION

The versatility of tractors and like equipment is in part provided by tractor-supported hitch arrangements which permit attachment of a wide variety of implements to a tractor. Hitching arrangements of this nature may be provided for tractors of all sizes, and typically include arrangements for mounting implements at the front and rear of the tractor. A well-known rear hitching arrangement is the so-called three point hitch, which supports an implement at the rear of the tractor at a pair of laterally spaced lower points and a centrally disposed upper point, usually in an adjustable fashion.

One type of implement which may be mounted on a tractor for purposes of mobility is a log splitter. A common configuration for a device of this nature includes an elongated frame which supports a cutting table. A hydraulically powered motor, usually a fluid ram, provides a working action for the splitter such that a log or piece of wood positioned on the splitter table is split by relative movement of the log and a blade of the splitter. In some arrangements, such as illustrated in U.S. Pat. Nos. 3,760,854, to Worthington, and 3,938,567, to Dircksen et al., the hydraulic motor is disposed such that the log is moved by the motor against a fixed blade mounted on the splitter to cause the log to split. In other arrangements, such as illustrated in U.S. Pat. No. 3,319,675 to Bles, Sr., the hydraulic motor is operatively connected with a movable blade projecting upwardly of the splitter table through a slot therein for splitting movement through the log which is held in position by a fixed abutment member.

Log splitters of this type are extremely useful for reducing logs or pieces of wood to manageable sizes for use in fireplaces, furnaces, and the like. Mounting of the log splitter on a tractor provides mobility so that the log splitter may be easily positioned in an area where large logs are located. The hydraulic system of the tractor is typically adapted to power the hydraulic motor of the log splitter so that an additional power source is not required.

While hydraulic log splitters of this type provide great labor savings by splitting logs in an efficient manner, a fair amount of physical effort is still necessary in order to pick up the logs or pieces of wood and position them atop the cutting table of the splitter. Obviously, this can present some problems when it is desired to split an unusually large log, and even at best, repeated use of the splitter to cut many logs can be physically demanding. Thus, a mounting arrangement for a log splitter which would permit reorientation of the splitter along its longitudinal axis so that logs could be left on the ground and the splitter positioned for splitting without having to lift the log onto the cutting table would clearly provide tremendous labor savings and additional versatility for log splitting arrangements.

SUMMARY OF THE INVENTION

In accordance with the present invention, a mounting arrangement is disclosed for supporting a log splitter on a tractor hitch. The log splitter itself is preferably of the type having a linear working action, and is illustrated as including a double acting hydraulic motor or fluid ram.

The mounting arrangement includes a hitch adapter which is adapted to be fixedly mounted on the tractor hitch and supported thereby. This adapter is preferably of the type suited for mounting on a three point tractor hitch.

The mounting arrangement includes means for adjustably mounting the log splitter on the hitch adapter. The arrangement is such that the log splitter may be selectively reoriented or repositioned with respect to the hitch adapter along a line generally parallel to the line of working action of the splitter. In this way, the splitter may be moved into position by first maneuvering the tractor. The splitter may then be repositioned with respect to the tractor hitch so that its cutting table faces sideways or downwardly. A log may then be moved into cutting position without lifting it from the ground.

In the preferred embodiment, the adjustable mounting includes a female socket connected with one of the hitch adapter and the log splitter, and a male plug adapted to be received by the female socket mounted on the other of the adapter and splitter. The female socket and male plug preferably each have a cylindrical configuration so that the plug nests within the socket.

In order to provide for selected positioning of the splitter with respect to the hitch adapter, a locking arrangement is provided for selectively maintaining the splitter in fixed relation to the adapter. The locking arrangement includes a spring biased locking pin movably mounted on the female socket which extends inwardly of the socket. The locking pin is adapted to be received by one of a plurality of circumferentially spaced holes defined by the male plug.

Adjustments of the angular disposition of the log splitter are easily accomplished by withdrawing the locking pin against the spring biasing action until it is disengaged from the male plug, and then rotating the log splitter with respect to the hitch adapter until it is in the desired position. The locking pin is then released so that it again is aligned with and extends into one of the holes in the male plug, and thus engages and firmly maintains the male plug in fixed relation with respect to the female socket. Preferably, the line about which the log splitter is repositioned is relatively close to its center of gravity so that rotation of the splitter may be accomplished without undue physical effort.

Numerous other advantages and features of the present invention will become readily apparent from the following detailed description of the invention and embodiments thereof, from the claims and from the accompanying drawings in which like numerals are employed to designate like parts throughout the same

DETAILED DESCRIPTION

Figures 1, 2:
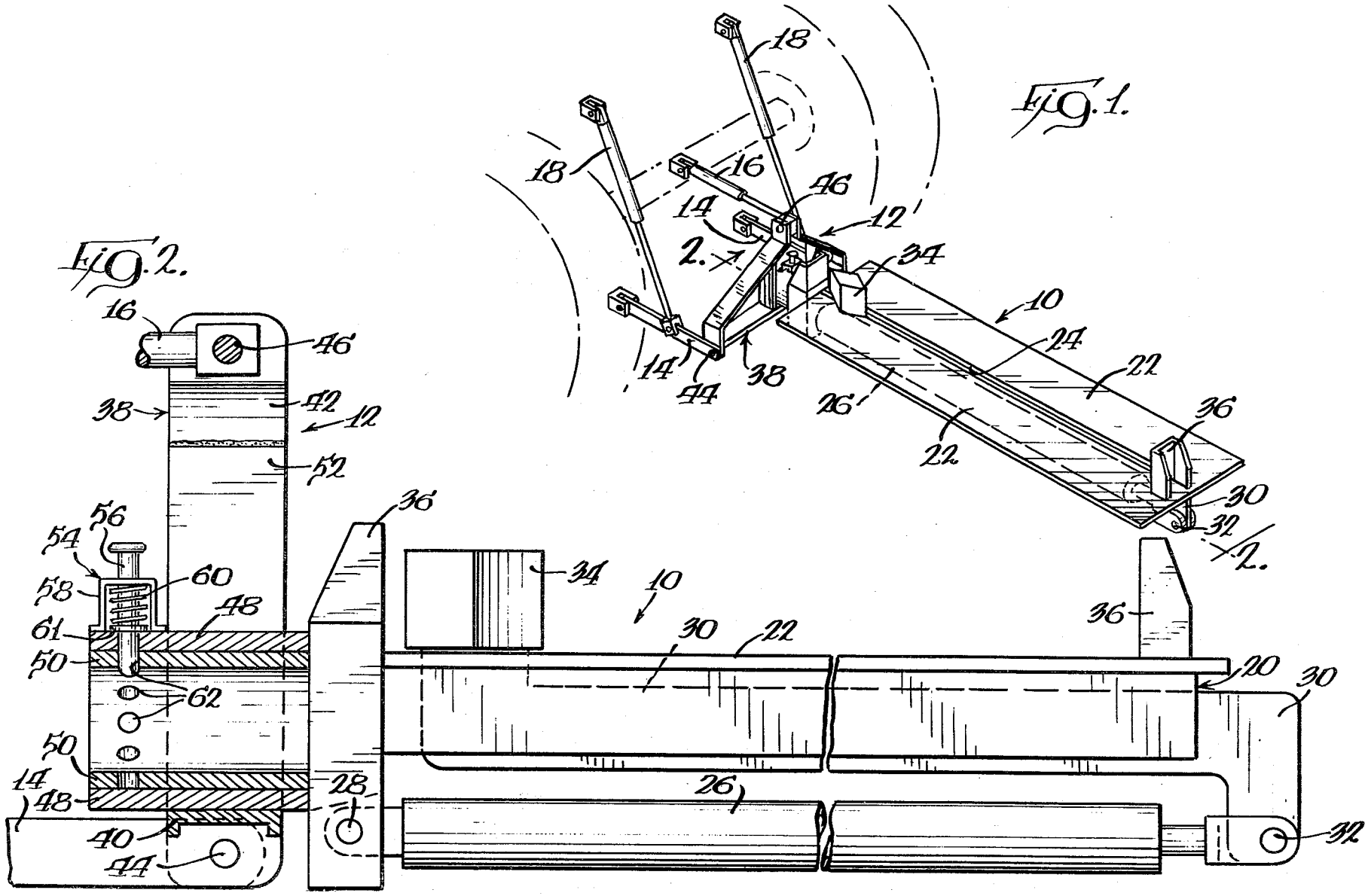
FIG. 1 is a perspective view of a log splitter supported upon a tractor hitch by the mounting arrangement of the present invention.
FIG. 2 is a side elevational view in partial cross-section taken along lines 2—2 of FIG. 1.

While the present invention is susceptible to embodiment in different forms, there is shown in the drawings and will hereinafter be described a presently preferred embodiment and a modification thereof with the understanding that the present disclosure is to be considered as an exemplification of the invention and is not intended to limit the invention to the specific embodiments illustrated.

With reference to FIG. 1, a log splitter 10 is illustrated supported by a mounting arrangement 12 on a so-called three point hitch of a tractor (shown in phantom). While the present disclosure describes mounting arrangement 12 in association with a three point tractor hitch, it will be appreciated that a mounting arrangement in accordance with the principles of the present invention could be provided for mounting log splitter 10 on any of a variety of hitch arrangements on tractors or other similar equipment.

As shown, the three point tractor hitch includes a pair of laterally spaced lower hitch members 14 extending rearwardly of the tractor frame. The hitch further includes an upper hitch member 16 which is disposed centrally of lower hitch members 14 and in vertically spaced relation thereto. While three point tractor hitches may have various configurations, the typical hitch illustrated includes a pair of hydraulic motors 18 extending between lower hitch members 14 and the tractor frame so that the attitude of the implement supported by the hitch may be selectively altered. Additionally, upper hitch member 16 may comprise a suitable hydraulic motor so that further adjustability of the hitch-supported implement is provided.

As best shown in FIG. 2, log splitter 10 includes a generally elongated splitter frame 20. Splitter frame 20 supports a slotted cutting table 22 which defines table slot 24 extending longitudinally of the log splitter.

The working action of log splitter 10 is provided by a double acting fluid ram or hydraulic motor 26. Hydraulic motor 26 is supported by splitter frame 20 and is disposed beneath cutting table 22. One end of hydraulic motor 26 is connected with splitter frame 20 at connection 28, while the other end of the hydraulic motor is connected to an elongated, generally Z-shaped blade bar or link 30 at connection 32. Blade bar 30 extends longitudinally of splitter 10 and is connected to splitter blade 34. Blade 34 includes a pair of oppositely disposed cutting edges, and is moved by the action of hydraulic motor 26 through blade bar 30 so that a linear cutting or splitting action is provided.

An abutment member 36 is provided at each end of cutting table 22 so that logs or pieces of wood to be split may be positioned on cutting table 22 and split by movement of blade 34 relative thereto. The inclusion of a pair of cutting surfaces on blade 34, and an abutment member 36 at each end of the cutting table permit the splitter to make a cutting stroke in each direction as the double acting hydraulic motor 26 is reciprocably stroked. Pressurized hydraulic fluid powering hydraulic motor 26 is typically provided by the hydraulic system of the tractor upon which log splitter 10 is mounted.

Figure 3:
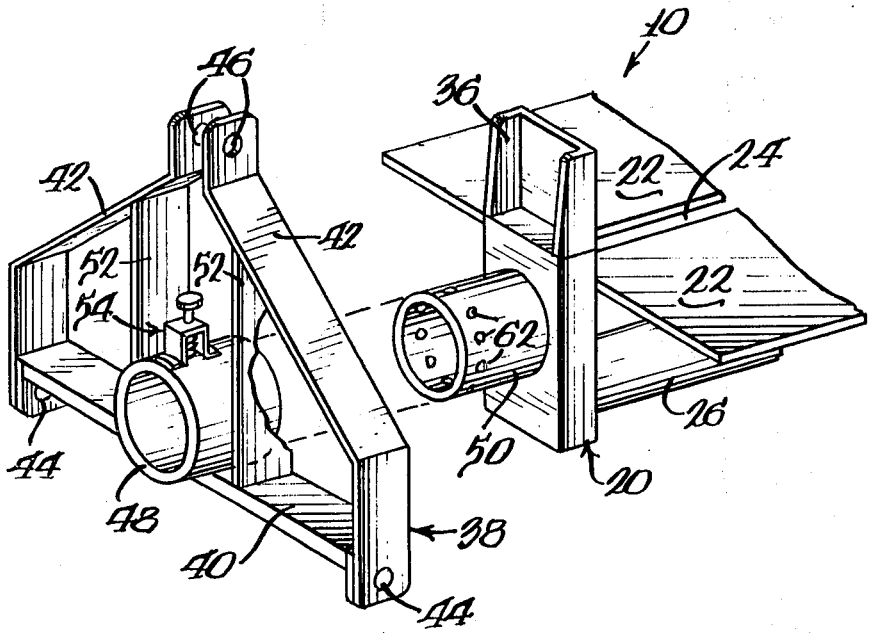
FIG. 3 is an enlarged perspective view of the log splitter mounting arrangement illustrated in FIG. 1.

So that log splitter 10 is firmly supported by the tractor hitch, mounting arrangement 12 includes a hitch adapter 38. As best shown in FIGS. 2 and 3, hitch adapter 38 comprises a laterally extending lower adapter member 40, and a pair of laterally spaced upper adapter members 42. Each upper adapter member 42 includes a lower end portion respectively connected to one of the opposite end portions of the lower adapter member, and each member 42 extends upwardly therefrom toward the other upper adapter member. Attachment and mounting of hitch adapter 38 to the three point tractor hitch is provided at the lower end portion of each upper adapter member 42, which are each connectable to one of lower hitch member 14 at lower hitch connection 44, and at the upper portion of upper adapter members 42 which are connectable to upper hitch member 16 at upper hitch connection 46. As noted earlier, hitch adapter 38 could be easily modified so as to be mountable on any of a variety of tractor hitches.

In order to provide for adjustable mounting of log splitter 10 on hitch adapter 38, mounting arrangement 12 further includes a releasable coupling for releasably mounting the splitter on the adapter. The coupling includes a female socket 48 fixedly supported upon lower adapter member 40 of the hitch adapter such as by welding or other suitable mechanical fastening means. As shown in FIG. 3, a pair of laterally spaced reinforcement members 52 extend between lower adapter member 40 and upper adapter members 42, and are rigidly attached to female socket 48 for reinforcement thereof. It will be appreciated that in view of the cantilevered disposition of log splitter 10 with respect to female socket 48, socket 48 must be sufficiently reinforced so that it may support log splitter 10 as well as any log or piece of wood disposed on cutting table 22 without failure. Female socket 48 preferably has a generally cylindrical tubular configuration, although it will be appreciated that other configurations could be adapted for use in adjustably mounting log splitter 10.

Support of log splitter 10 by female socket 48 is provided by a male plug 50 fixedly mounted on splitter frame 20 of the splitter. Male plug 50 preferably has a configuration complemental to that of female socket 48 so that plug 50 may be received by and nestable within the female socket. As shown, male plug 50 has a generally cylindrical configuration and is adapted to be positioned in concentric relationship within female socket 48. In this way, log splitter 10 may be supported by socket 48 and rotatably repositioned relative thereto about a line generally parallel to the line of the linear cutting action of the splitter. In this way, splitter 10 may be positioned with respect to a log for splitting without the necessity of the log being lifted and placed upon cutting table 22. So that rotation of the splitter with respect to hitch adapter 38 may be accomplished without undue physical effort, the line about which the splitter is repositioned is preferably disposed as near to the center of gravity of the splitter as practicable.

So that log splitter 10 may be maintained in fixed relation to hitch adapter 38 after it has been rotated to the desired position, a lock mechanism 54 is provided. As best shown in FIG. 2, lock mechanism 54 is mounted on female socket 48, and includes a movable locking pin 56 which extends through the wall of female socket 48 inwardly thereof. Locking pin 56 is biased inwardly of female socket 48 by pin spring 60 reactively held captive between pin bracket 58 and a washer 61 fixed to locking pin 56.

In order to provide for positive engagement of locking pin 56 with male plug 50 connected to log splitter 10, plug 50 defines a plurality of circumferentially spaced pin apertures 62. Each aperture 62 is adapted to receive locking pin 56 so that relative movement of male plug 50 and female socket 48 is prevented, and so that plug 50 may not be withdrawn from socket 48. Widthdrawal of locking pin 56 from one of pin apertures 62 against the biasing action of pin spring 60 permits log splitter 10 to be adjustably rotated with respect to hitch adapter 38, or the log splitter may be completely detached from hitch adapter 38 (after hydraulic lines to hydraulic motor 26 are disconnected) for service or storage of the log splitter.

Use of the log splitter mounted as disclosed greatly increases the versatility of the log or wood splitting operations which may be performed. Splitter 10 is suitably positioned by maneuvering the tractor upon which it is supported, and by adjusting the hydraulic motors of the three point tractor hitch (when such adjustment is possible). After the log splitter is positioned as desired, the splitter may be used in a normal fashion, wherein cutting table 22 is upwardly facing, by positioning a log on table 22 with one of its ends abutting one of abutment members 36, and then operating hydraulic motor 26 so that relative movement of blade 34 splits the log.

When logs to be split may not be conveniently placed upon cutting table 22, log splitter 10 may be easily repositioned by withdrawing lock pin 56 of lock mechanism 54 from disposition in one of apertures 62 so that pin 56 is disengaged from male plug 50. The entire log splitter may now be rotated and repositioned with respect to hitch adapter 38 so that cutting table 22 is facing other than upwardly, and locking pin 56 released so that it is again biased into engagement with male plug 50 by disposition of the pin in one of pin apertures 62.

For instance, splitter 20 may be rotated so that cutting table 22 faces sideways, and then logs to be split may be roled or otherwise moved into position adjacent the table. The splitter may then be operated to split the logs without having to pick the logs up off of the ground. Similarly, splitter 10 may be rotated so that cutting table 22 faces generally downwardly, with the splitter and/or the log then suitably positioned so that the log may be split into pieces of more manageable size without having to lift it onto cutting table 22.

Figure 4:
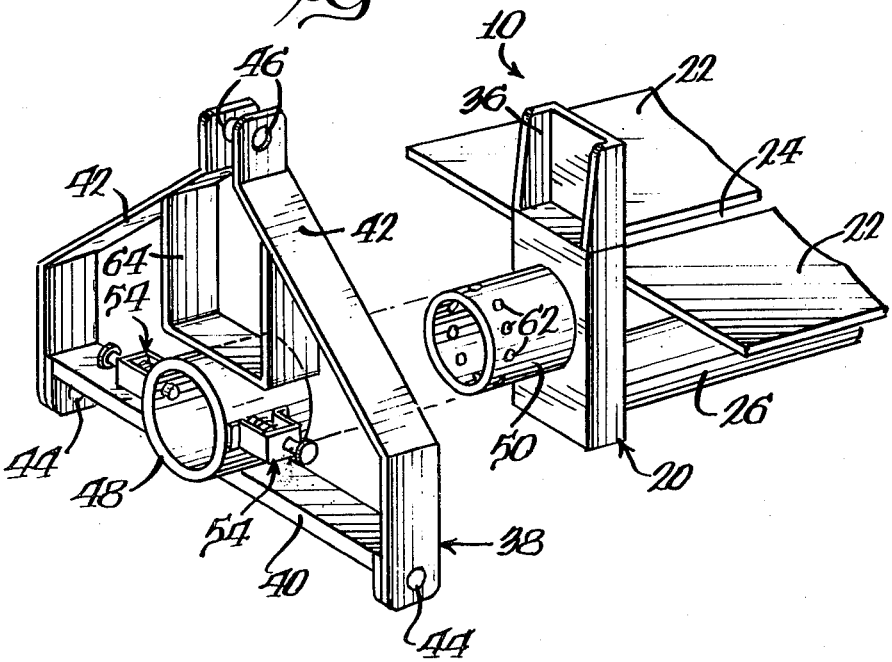
FIG. 4 is a perspective view similar to FIG. 3 illustrating a modification of the mounting arrangement of the present invention.

FIG. 4 illustrates a modification of the log splitter mounting arrangement of the present invention. The mounting arrangment shown in this figure is substantially similar to the arrangement previously described, but differs in that a pair of lock mechanisms 54, comprising spring biased locking pins, are provided on diametrically opposed sides of female socket 48. Inclusion of a pair of lock mechanisms 54 may be desirable where additional locking action between female socket 48 and male plug 50 is necessary. Refinforcement of female socket 48 is suitably provided by a generally U-shaped reinforcement member 64 so that clearance is provided for lock mechanisms 54. As noted above, the amount of reinforcement of female socket 48 required depends upon the stresses put upon the socket by the cantilevered log splitter 10.

Thus, a novel mounting arrangement for a log splitter is disclosed which permits reorientation of the splitter with respect to the tractor hitch which supports this about a line generally parallel to the line of working action of the splitter. In this way, splitting of logs not easily positioned atop the cutting table of the splitter is accommodated by repositioning the splitter on the tractor hitch for splitting the logs while they are still on the ground.

From the foregoing, it will be observed that numerous variations and modifications may be effected without departing from the true spirit and scope of the novel concept of the present invention. It will be understood that no limitation with respect to the specific embodiments illustrated herein is intended or should be inferred. It is, of course, intened to cover by the appended claims all such modifications that fall within the scope of the claims.

What is claimed is:

1. A mounting arrangement for supporting a log splitter having a linear working action on a tractor hitch, comprising:

adapter means adapted to be fixedly mounted on said hitch and supported thereby, and mounting means for adjustably mounting said log splitter on said adapter means whereby said log splitter may be selectively reoriented with respect to said hitch adapter about a line generally parallel to the line of working action of said log splitter.

2. A mounting arrangement in accordance with claim 1, wherein said mounting means comprise female means mounted on one of said adapter means and log splitter, and male adapted to be received by said female means on the other of said adapter means and log splitter.

3. A mounting arrangement in accordance with claims 1 or 2, wherein said mounting means comprise locking means for selectively maintining said log splitter in fixed relation to said adapter means.

4. A log splitter arrangement adapted to be mounted on a tractor hitch, comprising:

a log splitter having a linear working action including hydraulic motor means associated with blade means for providing relative linear movement of the blade means and an associated piece of wood to be split, a hitch adapter adapted to be fixedly mounted on said hitch and supported thereby, and mounting means for adjustably mounting said log splitter on said hitch adapter including female means on one of said hitch adapter and said log splitter, and male means on the other of said hitch adapter and log splitter, said male means being receivable by said female means, and releasable locking means for releasably locking said male and female means together in one of a plurality of relative dispositions, whereby said log splitter may be repositioned with respect to said hitch adapter about a line generally parallel to the line of working action of the log splitter and then maintained in fixed relation to said hitch adapter by said mounting means.

5. A log splitter arrangement in accordance with claim 4, wherein said female means comprise a cylindrical, tubular socket and said male means comprise a cylindrical plug nestable in said socket, and said mounting means comprise a plurality of circumferentially spaced apertures defined by said plug, and movable pin means on said socket receivable by said apertures and biased into engagement with said plug.

* * * * *